US007849708B2

(12) United States Patent
Goncharko et al.

(10) Patent No.: US 7,849,708 B2
(45) Date of Patent: Dec. 14, 2010

(54) TEMPERATURE CONTROLLED SHIPPING USING ONE OR MORE SMALLER INSULATED CONTAINERS INSIDE A LARGER INSULATED CONTAINER

(75) Inventors: Michael Goncharko, Englishtown, NJ (US); Maurice Barakat, Short Hills, NJ (US)

(73) Assignee: TCP Reliable, Inc., Edison, NJ (US)

( * ) Notice: Subject to any disclaimer, the term of this patent is extended or adjusted under 35 U.S.C. 154(b) by 587 days.

(21) Appl. No.: 11/676,611

(22) Filed: Feb. 20, 2007

(65) Prior Publication Data

US 2008/0197139 A1 Aug. 21, 2008

(51) Int. Cl.
*F25D 3/08* (2006.01)

(52) U.S. Cl. ..... 62/371

(58) Field of Classification Search ..... 62/371, 62/457.2, 457.5, 530
See application file for complete search history.

(56) References Cited

U.S. PATENT DOCUMENTS

| | | | | |
|---|---|---|---|---|
| 2,608,387 | A * | 8/1952 | Geoffrey | 165/160 |
| 5,103,651 | A * | 4/1992 | Coelho et al. | 62/341 |
| 5,647,226 | A * | 7/1997 | Scaringe et al. | 62/457.2 |
| 6,079,404 | A * | 6/2000 | Salyer | 126/263.03 |
| 6,116,042 | A * | 9/2000 | Purdum | 62/371 |
| 6,349,559 | B1 * | 2/2002 | Hasanovic | 62/457.7 |
| 6,761,041 | B2 * | 7/2004 | Roth et al. | 62/457.2 |

* cited by examiner

*Primary Examiner*—Melvin Jones
(74) *Attorney, Agent, or Firm*—Eric P. Mirabel

(57) ABSTRACT

Insulated containers which conform relatively closely in size to the payload size, which contain a payload and phase change material and/or a refrigerated gel are all placed in a larger insulated shipping container, which may house additional phase change material and/or refrigerant. The combined insulating effect of the inner and outer containers allows minimizing the use of phase change material inside the inner container for the payload itself, and the presence of the phase material, together with the use of frozen gels inside the outer container, provides for only a small difference in temperature between the interior of the inner container and the interior of the outer container. The inner containers can be less insulated and lower cost, and the outer containers can be recycled.

2 Claims, 1 Drawing Sheet

TEMPERATURE CONTROLLED SHIPPING USING ONE OR MORE SMALLER INSULATED CONTAINERS INSIDE A LARGER INSULATED CONTAINER

FIELD OF THE INVENTION

The disclosure relates to insulated shipping containers.

BACKGROUND

In the pharmaceutical, transplant and food industries, insulated containers are widely used to maintain the temperature of shipped materials near refrigeration levels, thereby promoting preservation of the material. Such containers can be made from a number of materials including expanded polystyrene (EPS), extruded polystyrene (XPS), urethane foam, vacuum insulated panels (VIP) or other insulating materials. The cost of containers appropriate to maintain a shipment between 2 and 8° C. (i.e., at refrigeration levels, as needed for biological products, food, medical products and others) or near room temperature, can be relatively high, as the containers are only of particular sizes, and generally cannot be well-matched to the payload size. In addition, the containers themselves are heavy and large, and, if made of standard foam materials (e.g., EPS), are not readily recyclable, generating disposal problems, additional costs and environmental concerns. Re-using the larger foam containers would therefore be advantageous, as it would eliminate the recycling concerns. Additionally, if more boxes (which conform to the dimensions of the payload more closely) are used in the interior of such larger containers, there would be additional insulation for the payload.

SUMMARY

Insulated containers which conform relatively closely in size to the payload size, and, where refrigeration is desired, such smaller containers containing a payload and phase change material (e.g., Phase 5™, by TCP Reliable, Inc., Edison, N.J., which is 1-Decanol) or a refrigerated gel (also called "frozen gel packs") are all placed in a larger insulated shipping container, which may also house additional phase change material and/or refrigerant. The combined insulating effect of the inner and outer containers allows minimizing the use of phase change material inside the inner container for the payload itself, and the presence of the phase material, together with the use of frozen gels inside the outer container, provides for only a small difference in temperature between the interior of the inner container and the interior of the outer container. Moreover, this arrangement reduces temperature change of the payload (inside the inner container) to ambient air when the outer container is opened, as often happens in transit for multi-stop distribution, customs inspection, regulatory review or otherwise. The smaller inner container still protects and temperature-regulates the payload after it is delivered, and the outer container is removed. This is important as the items will often remain on a loading dock or in an office waiting for the actual recipient to come and pick it up.

The effect of the arrangement described herein is that the inner container does not needs to provide as much total thermal protection (a thinner-walled, less expensive inner container is sufficient) and the amount of phase change or refrigerant materials in the inner container can be less, due to a lower differential in temperature from the payload of the inside container to the outside container, than would be needed if the inner container with the payload were shipped stand-alone. Also, from a regulatory standpoint, the user need only qualify the inner container for regulatory compliance. While it would normally be necessary to qualify the container over a temperature profile typically encountered in shipping (which could be a wide range, where the inner container is the only one used), where two containers are used and the two containers are designed to be shipped in a vehicle with some degree of control over the payload-hold, the validation can be done over a much narrower range of temperatures, or even at isothermal conditions, if appropriate.

The outer container can be in a range of sizes, wall-thickness and insulation type, and still function effectively as an additional insulating layer for the inner container and any phase change or refrigerant material therein. A relatively wide range of refrigerant materials are suitable, due to the additional insulation provided by the outer container—it does not have to be specified as precisely. From a regulatory standpoint, any refrigerant is suitable which can allow validation at such refrigerant's worst case temperature.

DETAILED DESCRIPTION

Figure 1:
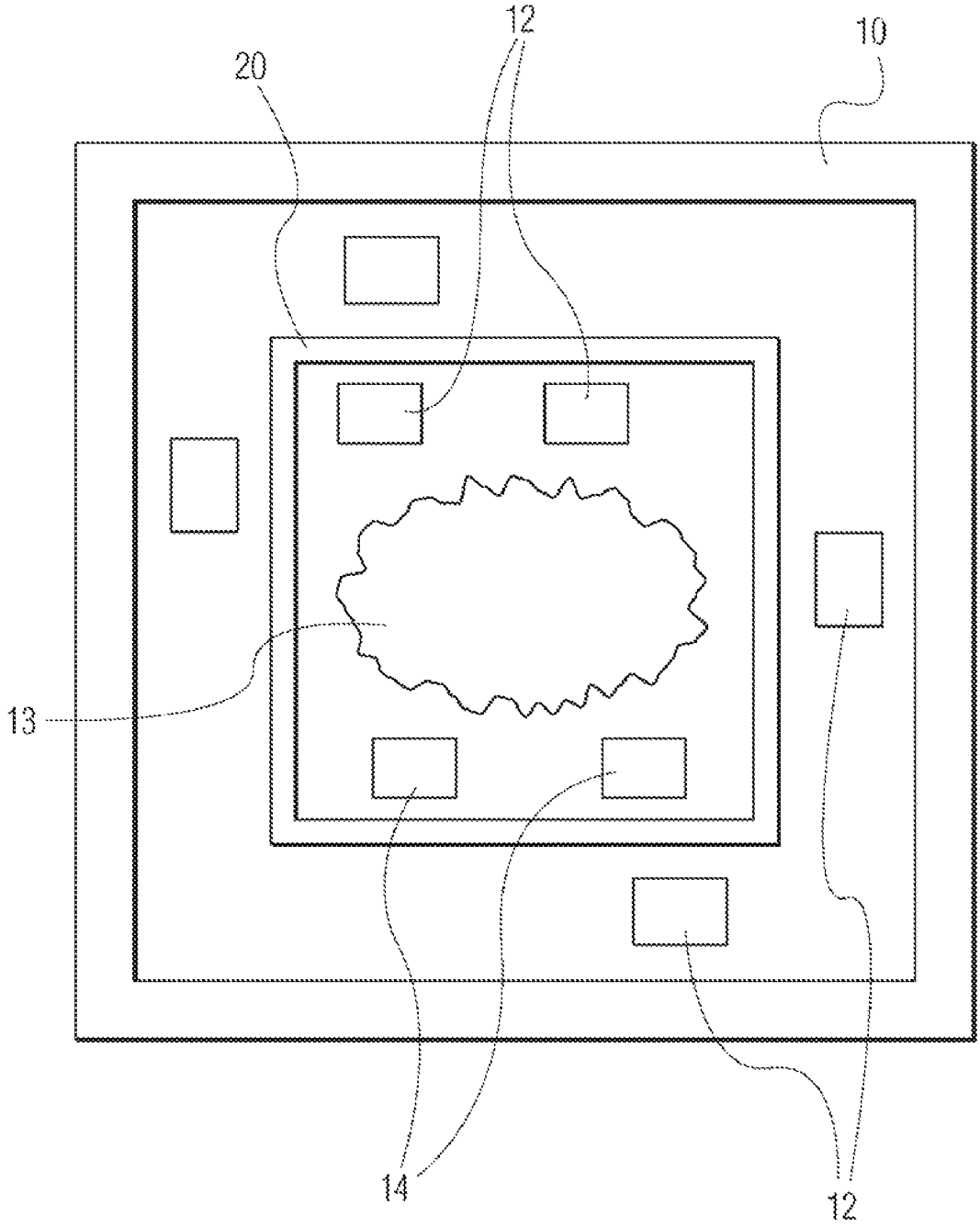
FIG. 1 is a section view from the top of a smaller insulated container inside a larger insulated container.

The container-in-container (see FIG. 1) described herein is particularly well-suited for shipping payloads needing temperature regulation for local "one-day" delivery. The container-in-container (with payload 13 in place in the inner container 20, along with phase change material 14 and/or refrigerant 12, as appropriate) is loaded from the warehouse into the delivery vehicle. The vehicle has some temperature regulation in its cargo hold (e.g., either a heater or an air conditioner) to maintain a narrower temperature range than the ambient. At the delivery point, the outer container 10 is opened, and the thinner-walled inner container 20 containing payload 13 is left with the customer. The outer container 10 is retained for subsequent use.

The container-in-container described herein also permits reusing a stock of larger insulated coolers or shippers that accumulate at a product distribution center, and are normally discarded. The smaller insulated container or containers with phase change material and/or gels is placed inside these larger containers, along with frozen gels, and can then be shipped. The advantages include the lessened environmental impact and the cost savings to the distributor, both of which result from the re-using of the larger container, which further allows reduction in the insulation in the smaller container, and reduction in the refrigerant and phase change materials in the smaller container.

In an exemplary procedure, a panel 14 is filled with 0.5 pounds of a phase change material having the desired phase change temperature for the payload (e.g., decanol-1), and is placed into close thermal proximity with a payload that needs to be kept between 2 and 8° C. The panel 14 and payload are secured together with bubble wrap (not shown) and placed in a small insulated container 20. The end user places the small insulated container 20 in his own cooler 10 and includes frozen gel packs 12 for better temperature regulation.

Is should be understood that the terms, expressions and embodiments described herein are exemplary only and not limiting, and that the scope of the invention is defined only in the claims which follow, and includes all equivalents of the subject matter of those claims.

What is claimed is:

1. A shipping system for regulating temperature of a payload, an inner insulated container containing within it the payload and 1-Decanol; and a second insulated container containing the inner insulated container and frozen gel packs within it, wherein the frozen gel packs are situated outside the inner insulated container.

2. A method of reducing temperature fluctuations for a payload shipped to a destination inside an inner insulated container, comprising:

including 1-Decanol inside the inner insulated container;

placing the inner insulated container inside a larger insulated container, wherein the larger insulated container includes frozen gel packs within it, wherein the frozen gel packs are situated outside the inner insulated container; and transporting the larger insulated container to the destination.

* * * * *

UNITED STATES PATENT AND TRADEMARK OFFICE

CERTIFICATE OF CORRECTION

PATENT NO. : 7,849,708 B2
APPLICATION NO. : 11/676611
DATED : December 14, 2010
INVENTOR(S) : M. Goncharko It is certified that error appears in the above-identified patent and that said Letters Patent is hereby corrected as shown below:

Column 3, line 2;
In claim 1, please insert the term --comprising-- in the first line, following the first occurrence of the word "payload," and before the word "an".

Signed and Sealed this
Eighth Day of February, 2011

David J. Kappos

David J. Kappos
*Director of the United States Patent and Trademark Office*